US005148194A

United States Patent [19]

Asai et al.

[11] Patent Number: 5,148,194

[45] Date of Patent: Sep. 15, 1992

[54] INK JET RECORDING APPARATUS WITH ENGAGING MEMBERS FOR PRECISELY POSITIONING ADJACENT HEADS

[75] Inventors: Naohito Asai, Hiratsuka; Kazuaki Masuda, Sagamihara, both of Japan

[73] Assignee: Canon Kabushiki Kaisha, Tokyo, Japan

[21] Appl. No.: 629,038

[22] Filed: Dec. 19, 1990

Related U.S. Application Data

[63] Continuation of Ser. No. 319,849, Mar. 6, 1989, abandoned, which is a continuation of Ser. No. 53,544, May 26, 1987, abandoned, which is a continuation of Ser. No. 759,883, Jul. 29, 1985, abandoned.

[30] Foreign Application Priority Data

| | | | |
|---|---|---|---|
| Aug. 6, 1984 | [JP] | Japan | 59-163897 |
| Oct. 9, 1984 | [JP] | Japan | 59-151833[U] |
| Oct. 9, 1984 | [JP] | Japan | 59-210554 |

[51] Int. Cl.[5] ..... B41J 2/01

[52] U.S. Cl. ..... 346/140 R; 346/139 C; 400/175

[58] Field of Search ..... 346/140, 75, 139 C; 400/175

[56] References Cited

U.S. PATENT DOCUMENTS

| | | | |
|---|---|---|---|
| 337,744 | 3/1886 | Cummings | 101/398 |
| 635,651 | 10/1899 | Campfield | 101/398 |
| 715,936 | 12/1902 | Ames | 101/398 |
| 744,836 | 11/1903 | Weeks | 101/398 |
| 984,207 | 2/1911 | Gaunt | 101/398 |
| 1,078,400 | 11/1913 | Allen | 101/398 |
| 1,176,204 | 3/1916 | Crabbs | 101/398 |
| 1,657,437 | 1/1928 | Shinohara | 101/398 |
| 3,747,120 | 7/1973 | Stemme | 346/140 X |
| 3,946,398 | 3/1976 | Kyser | 346/140 X |
| 4,004,197 | 1/1977 | Hawkes | 200/307 X |
| 4,224,484 | 9/1980 | Haas | 200/307 X |
| 4,345,262 | 8/1982 | Shirato | 346/140 |
| 4,385,304 | 5/1983 | Sniderman | 346/140 |
| 4,423,465 | 12/1983 | Teng-Ching | 361/394 |
| 4,455,560 | 6/1984 | Louzil | 346/140 |
| 4,540,996 | 9/1985 | Saito | 346/140 R |
| 4,564,732 | 1/1986 | Lancaster | 403/381 X |
| 4,611,219 | 9/1986 | Sugitani et al. | 346/140 R |

FOREIGN PATENT DOCUMENTS

| | | |
|---|---|---|
| 3317079 | 11/1983 | Fed. Rep. of Germany . |
| 6919070 | 5/1989 | Fed. Rep. of Germany . |
| 2518901 | 1/1983 | France . |

OTHER PUBLICATIONS

Patent Abstracts of Japan, vol. 9, No. 63 (Mar. 20, 1985).

*Primary Examiner*—Joseph W. Hartary

*Attorney, Agent, or Firm*—Fitzpatrick, Cella, Harper & Scinto

[57] ABSTRACT

A liquid jet recording head comprises a recording apparatus having an orifice for discharging liquid and an energy generator for generating energy to discharge the liquid. Each recording head has an engaging member which is of complementary contour to an engaging member of another recording head. The engaging members are disposed in a different location on each recording head so that recording heads for different colors are located properly in the apparatus.

15 Claims, 13 Drawing Sheets

INK JET RECORDING APPARATUS WITH ENGAGING MEMBERS FOR PRECISELY POSITIONING ADJACENT HEADS

This application is a continuation of application Ser. No. 07/319,849 filed Mar. 6, 1989, which is a continuation of application Ser. No. 07/053,544 filed May 26, 1987, which is a continuation of application Ser. No. 06/759,883 filed Jul. 29, 1985, all now abandoned.

BACKGROUND OF THE INVENTION

1. Field of the Invention

The present invention relates to a liquid jet recording head and a liquid jet recorder having the same, and more particularly to a liquid jet recording head having means for forming recording liquid droplets and a liquid jet recorder having such a liquid jet recording head.

2. Description of the Prior Art

A liquid jet recording head applied to a liquid jet recording system usually has a fine liquid discharging orifice, a liquid path and a liquid discharge energy generator arranged in the liquid path.

In the past, the liquid jet recording head has been manufactured in one of the following methods. (1) A fine groove is formed in a glass, ceramic or metal plate by grinding or etching and the plate is joined with another appropriate plate to form a liquid path. (2) A liquid path wall made of a photo-sensitive resin hardened film is formed on a substrate on which a liquid discharge energy generator is arranged, and the path is covered by a cover. (See Japanese Patent Laid-open Application No. 43876/1982). (3) A plate member having a liquid path wall formed by plating or resin molding is bonded to a substrate on which a liquid discharge energy generator is arranged.

Two or more liquid jet recording heads manufactured in the method described above are arranged in parallel and fixed to manufacture a multi-orifice liquid jet recording head, in a manner shown in FIGS. 1 to 4.

Numeral 1 denotes an orifice, numeral 3 denotes a liquid supply tube, numeral 31 denotes an individual liquid jet recording head having the orifice and the liquid supply tube, numeral 32 denotes a support plate, numeral 33 denotes a fixing bolt, numeral 34 denotes a groove (recess), numeral 35 denotes a fixing plate and numeral 36 denotes a positioning abutment.

(1) In FIG. 1, the individual liquid jet recording heads 31 are fixed on the support plate 32 by the bolts 33.

(2) In FIG. 2 the recesses 34 into which the individual liquid jet recording heads are to be fitted are formed in the support plate 32, and the liquid jet recording head are fitted to the recesses 34. They may be fixed by adhesive material if required.

(3) In FIG. 3, the individual liquid jet recording heads are arranged on the support plate 32 and the heads are pressed by the fixing plate 35.

(4) In FIG. 4, the positioning projections 36 are formed on the support plate 32 and the individual liquid jet recording heads are abutted thereto and fixed by bolts or adhesive material.

However, the above methods for arranging and fixing the liquid jet recording heads have the following disadvantages.

(1) When the individual liquid jet recording heads are arranged to form a multi-orifice head, the positioned relation of those individual liquid jet recording head has a significant effect on a recording quality (e.g. print quality). Accordingly, they must be positioned and fixed at a high precision. When they are arranged and fixed in the manner described above, the positions of the holes for the bolts in the fixing plate, the grooves (recesses) or the abutting projections must be manufactured with a high precision. As a result, the cost of the support plate increases and mass-production is not appropriate.

(2) If a mechanism (not shown) for finely adjusting the positions of the individual heads after the arrangement thereof in order to attain a high precision in the positional relation of the liquid jet recording heads, the cost further increases and the positioning process is complex.

In another prior art liquid jet recorder having the recording head shown in FIG. 5, an ink supply tube 502 is connected to a recording head 501, and ink 504 is supplied from an ink container 503 and reaches an end of the recording head 501. As an electrical signal is applied to a piezo-electric element arranged in the recording head, ink droplets 505 are discharged from the end or nozzle of the recording head 501 so that characters are printed on a record medium 506.

However, since the recording head 501 and the ink container 503 are connected through the ink supply tube 502, it is difficult to exchange the record head 501 when it fails. The small diameter tube used as the ink supply tube 502 has a sufficient length to be reciprocally moved with the carriage. Accordingly, a large space is required to allow the tube to be moved with the carriage.

In order to resolve the above problem, a liquid jet recorder shown in FIG. 6 has been proposed. A recording head 601 and an ink container 602 are in union to form a recording head unit 603 which is removably attached to a carriage 604. Ink in the ink container is discharged as ink droplets 606 from a nozzle 605 by a discharge energy generated by a piezo-electric element or a heat generating resistor arranged in the recording head 601. Numeral 607 denotes a slide shaft fixed to a printer body. The carriage 604 reciprocates along the slide shaft.

In such a prior art recorder, the positioning of the recording head unit 603 to the carriage 604 is done only by fixing means which fixes the head unit to the carriage 604. When a plurality of head units are mounted on the carriage, the positioning of the head units is done for each head unit by fixing it to the carriage. As a result, the alignment of the head units is not precise. When high density recording or color recording is to be done, the reach points on the record medium of the ink droplets discharged from the head units deviate from each other due to the misalignment of the head units and hence a high quality record is not attained.

As described above, such a liquid jet recording head may be manufactured by forming fine grooves on the glass or metal plate by grinding or etching, and joining the grooved plate to another appropriate plate to form the liquid paths.

In the head manufactured by the prior art method, roughness in the ground liquid path inner wall is too high or the liquid path has a strain due to a difference between etching rates. Accordingly, it is difficult to form a high precision liquid path and the liquid discharge characteristics of the recording heads thus manufactured are not uniform.

In the grinding step, the plate may be scratched or broken. Thus, a manufacturing yield is low. When the etching process is used, the number of manufacturing steps increases and the manufacturing cost increases.

As a common disadvantage to the prior art methods described above, it is difficult to precisely position the grooved plate having the liquid paths formed therein to the plate having the liquid discharge energy generator such as piezo-electric element or heat generating element arranged therein. Accordingly, mass-production is hardly attained.

In the liquid jet recording head manufacturing method, for example, disclosed in Japanese Patent Laid-open Application No. 43878/1982, a liquid path wall made of a photo-sensitive resin hardened film is formed on a substrate on which a liquid discharge energy generator is mounted, and a cover for the liquid path wall is formed.

The liquid jet recording head having the ink path wall made of the photo-sensitive resin hardened film, is excellent in that it resolves the finish precision of the liquid path, the complexity of the manufacturing process and the low manufacturing yield in the prior art liquid jet recording head.

The photo-sensitive resin may be one of those used in the field of photo-lithography such as photo-resist. For example, it may be diazo resin, P-diazo quinone, photopolymer which uses vinyl monomer and polymerization initiator, double photopolymer which uses polyvinyl cinnamate and sensitizer, mixture of orthonaphthoquinone diazide and novolak type phenol resin, mixture of polyvinyl alcohol and diazo resin, polyether type photo-polymer of 4-glycydil ethylenoxid and benzophenone or glycydil calcon, copolymer of N,N-dimethyl methacryl amide and acryl amide benzophene, unsaturated polyester photo-sensitive resin (e.g. APR (Asahi Kasei), Tevista (Teijin), Zonne (Kansai Paint)), unsaturated urethane oligomer photo-sensitive resin, photosensitive composition of bifunctional acrylic monomer, polymerization initializer and polymer, dichromate photo-resist, non-chrome-aqueous photo-resist, polycinnamic acid vinyl photo-resist, or cyclized rubber-azido photo-resist.

In addtion, DuPont 110-manent photo-polymer coating, RISTON, and solder masks 730S, 740S, 730FR, 740FR and SM1 may be used.

However, most of the aforementioned-photo-sensitive resins and commercially available resins are blue or red and none of the photo-sensitive resins has two or more colors of dyes or pigments added in the resin. Accordingly, the following disadvantages are encountered.

(1) In the manufacturing process of the liquid jet recording head, if two or more liquid jet recording heads are to be arranged to manufacture a multi-color liquid jet recording head, the monochromatic liquid jet recording heads are arranged in parallel and liquids of desired colors are injected to the respective heads. However, because the colors of the respective liquid jet recording heads are similar (the colors of the photo-sensitive resins are most distinctive), it is difficult to discriminate the heads and incorrect liquid may be injected to the head.

(2) In the recording head manufacturing process of the multi-color recording head having two or more recording heads arranged, when the heads for the respective colors have slight differences in the shape but do not have distinctive differences, the heads may be misarranged because of similar colors thereof.

(3) In the manufacturing process of the monochromatic recording head having two or more liquid jet recording heads of different nozzle densities and similar appearance, it is difficult to distinguish those heads by shape or by color, and they may be misarranged.

(4) The above items (1) to (3) are not preferable in the process management and lead to an increase of the member of steps, the decrease of the yield, and the increase of the cost of the liquid jet recording head.

SUMMARY OF THE INVENTION

It is an object of the present invention to provide a liquid jet recording head which is easy to exchange ink and an ink container, allows precise positioning of the recording head and is applicable to high density recording or color recording, and a liquid jet recorder having such a liquid jet recording head.

It is another object of the present invention to provide a low cost multi-orifice liquid jet recording head which allows precise arrangement of liquid jet recording heads to attain high quality image recording, and a liquid jet recorder having such a liquid jet recording head.

It is another object of the present invention to provide an inexpensive liquid jet recording head which is manufactured with reduced number of steps at a high yield, and a liquid jet recorder having such a liquid jet recording head.

It is another object of the present invention to provide a liquid jet recording head having a recording head unit including an orifice for discharging liquid and energy generation means for generating an energy to discharge the liquid, and coupling means for fitting to a liquid jet recording head other than the above liquid jet recording head.

It is another object of the present invention to provide a liquid jet recorder having a plurality of liquid jet recording heads each having a recording head unit including an orifice for discharging liquid and an energy generator for generating an energy to discharge the liquid, and coupling means for fitting the liquid jet recording heads to each other.

BRIEF DESCRIPTION OF THE DRAWINGS

FIGS. 7, 8 and 9 show a first embodiment of the present invention, in which FIG. 7 is an exploded perspective view of a liquid jet recording head, FIG. 8 is a perspective view of the liquid jet recording head, and FIG. 9 is a perspective view of an assembled multi-orifice liquid jet recording head, FIGS. 10, 11 and 12 show a second embodiment of the present invention, in which FIG. 10 is a sectional view of a liquid jet recording head, FIG. 11 is a perspective view and FIG. 12 is a perspective view of an assembled multi-orifice liquid jet recording head, FIG. 18 shows an eighth embodiment of the present invention and illustrates a color liquid jet recording head manufactured by the heads of FIG. 7, FIGS. 19 and 20 show a ninth embodiment of the present invention, in which

DETAILED DESCRIPTION OF THE PREFERRED EMBODIMENTS

Figure 2:
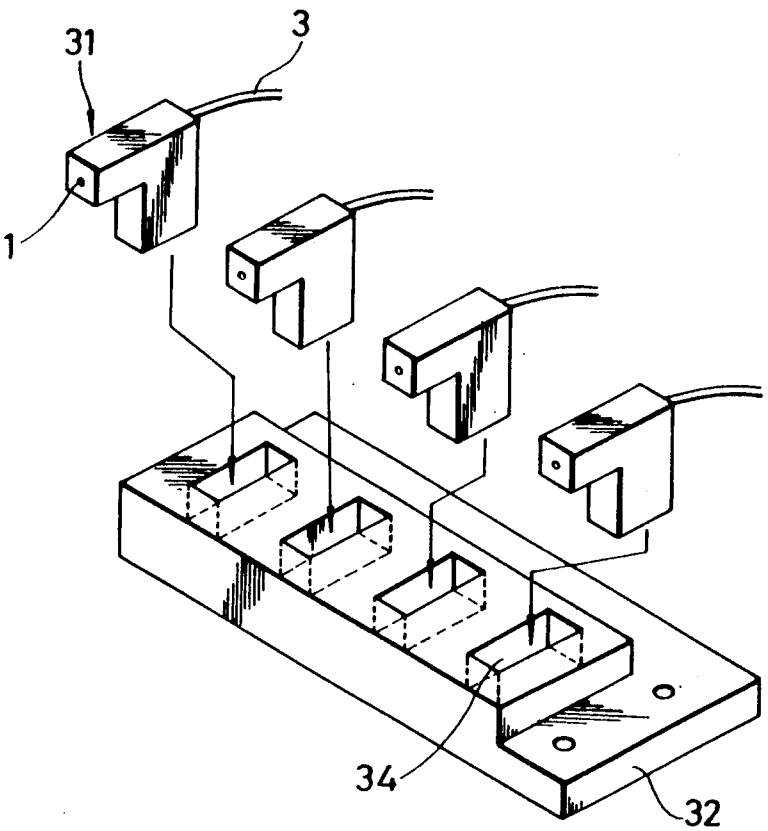
FIG. 2 PRIOR ART
FIGS. 1, 2, 3 and 4 show prior art multi-orifice liquid jet recording heads.
Figure 1:
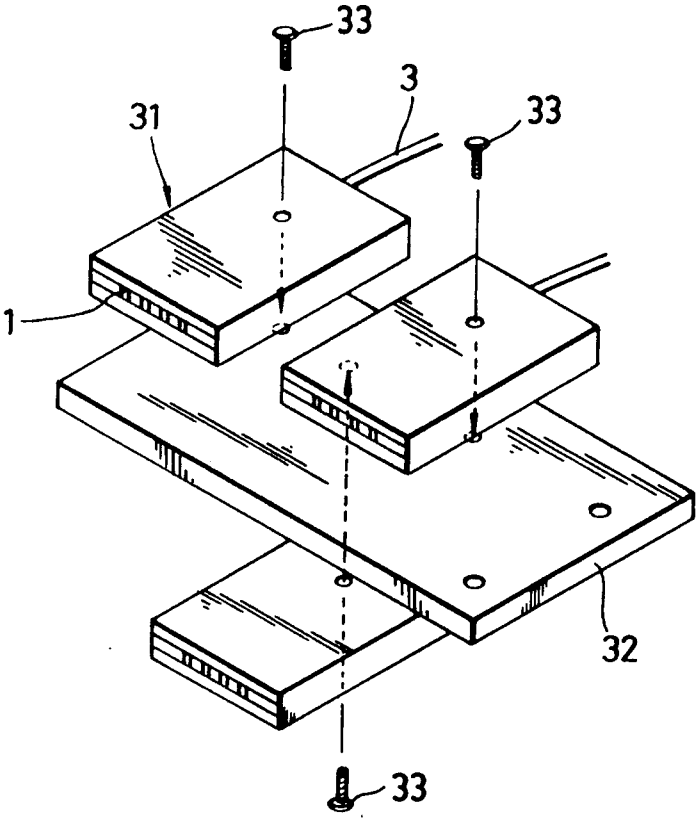
FIG. 1 PRIOR ART
Figure 3:
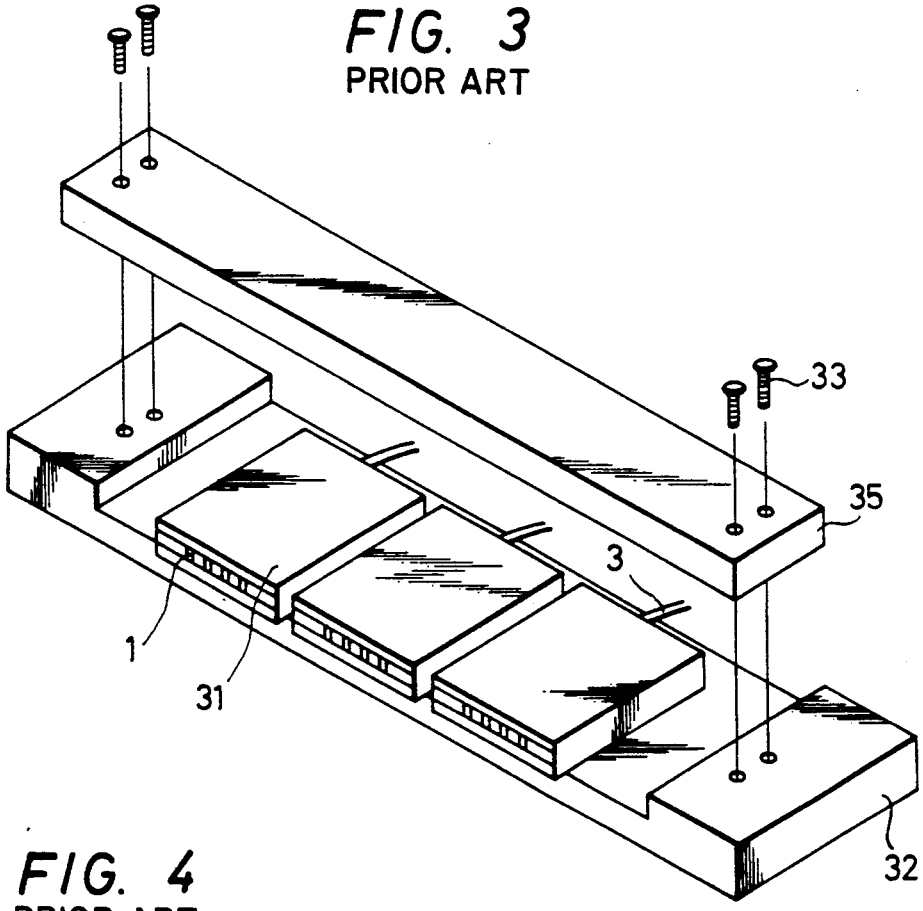
FIG. 3 PRIOR ART
Figure 4:
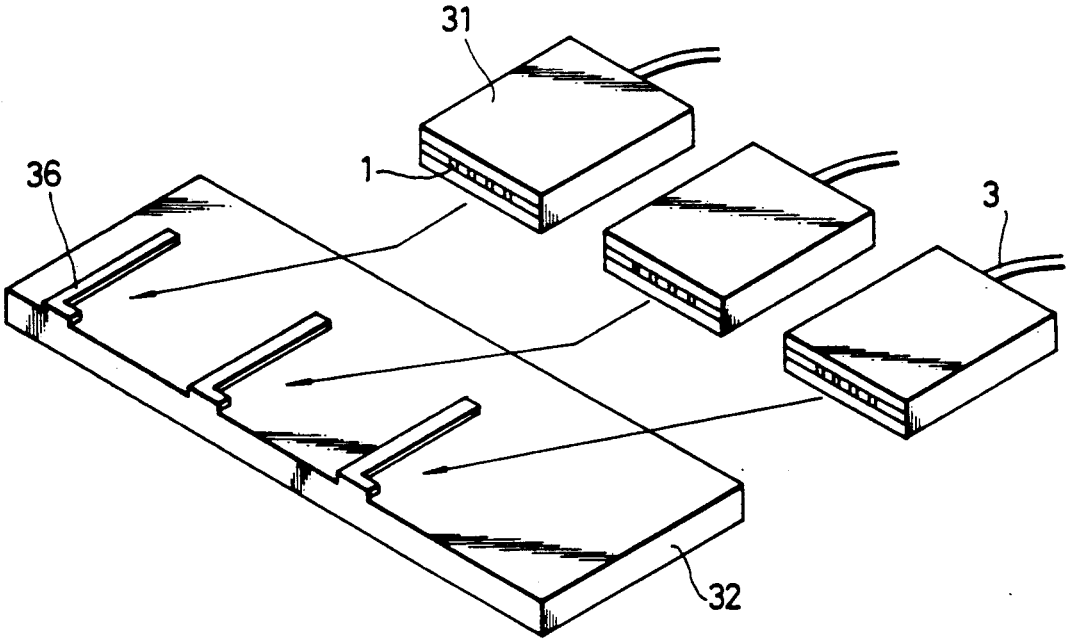
FIG. 4 PRIOR ART
Figure 5:
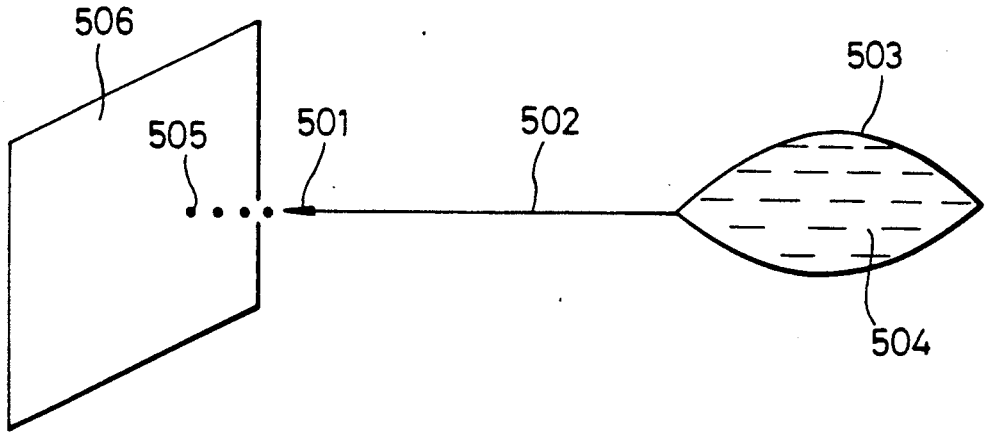
FIG. 5 PRIOR ART
FIGS. 5 and 6 show prior art ink jet printers.
Figure 6:
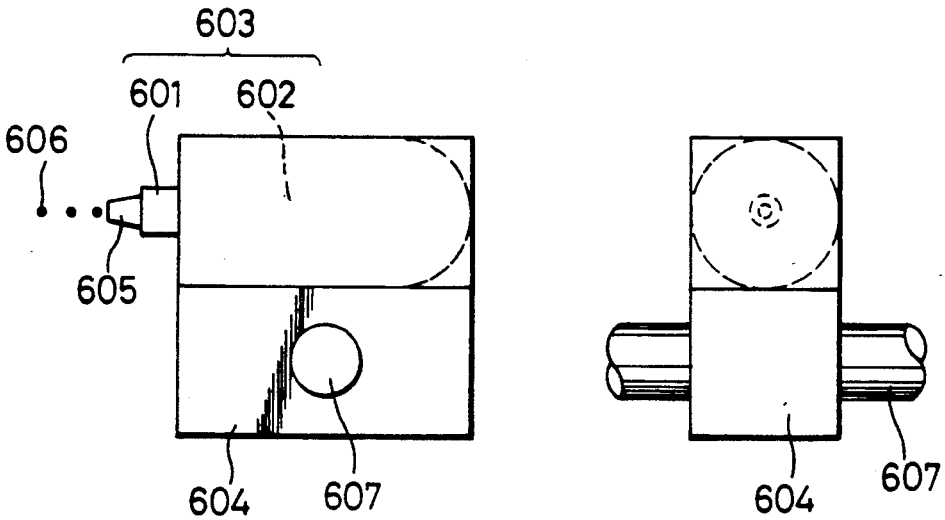
FIG. 6 PRIOR ART

The liquid jet recording head of the present invention has coupling or engaging means which fits to another adjacent recording head or a main body of an apparatus. The coupling is done by a projecting member and a recessed member. Accordingly, one recording head has the projecting member as the coupling member and another recording head which is to be arranged adjacently to the one recording head has the recessed member as the coupling means which complementarily fits and cooperates with the projecting member by fitting those members, the adjacent recording heads then being relatively fixed.

The coupling means defines the relative longitudinal and lateral positions of the adjacent recording heads. The coupling length of the coupling means (length of contact with the adjacent recording head) is preferably long, although it should be determined in view of the compactness of the recording head, the compactness of the apparatus and the physical strength of the coupling means.

The coupling means of the present invention is applicable not only to the recording head which is semi-fixedly mounted but also to a removable recording head which can be exchanged by a user. The coupling means may be formed in a liquid jet recording head unit having a recording head for forming droplets and an ink container for accommodating liquid to be supplied to the recording head. Of course, the coupling means must meet the requirements described above. Where the recording head unit is exchanged by another recording head unit when the liquid has been exhausted, the fitting and the removal of the coupling means are more frequently done than the coupling means of the semi-fixed recording heads. Accordingly, a higher physical strength is required. The coupling means should be constructed to better facilitate the fitting and removal.

The coupling means may have rectangular projection or recess, or may have polygon or curved shape. Two or more projections or recesses may be formed in one side.

It is very desirable to classify the recording head by color in improving the efficiency of the recording head manufacturing work and arranging work. The coloring is preferably done by the color of the member itself because it does not increase the number of production steps, although paint may be applied or seals may be applied.

According to the present invention, in the liquid jet recording head for the liquid jet recorder having the liquid jet recording head arranged, which has one or move discharge ports or, a discharge energy generator, a liquid path and a liquid container, the coupling means of complementary shape is formed in the area of the liquid jet recording head other than the orifice area. When a plurality of such liquid jet recording heads are arranged, the adjacent heads are self-supporting and fixed to each other by the complementary coupling means. Thus, it offers the following advantages.

(1) In the prior art structure, the individual heads are fixed by the support plate. Accordingly, a high head manufacturing precision and a high support plate precision are required. In the present invention, only the head manufacturing precision need be assured and the precision of the head support plate is not added to the head positioning precision because the heads are directly fitted to each other. Accordingly, high precision positioning of adjacent heads or, more specifically, of the discharge ports in adjacent heads, is attained.

(2) Since the precision of the support plate is not required, the support plate may be used to fix the heads without increasing the cost.

(3) Since the individual heads are fitted to each other, the manufacturing process is very much simplified, the workability is improved, the number of steps is reduced and the cost is reduced.

(4) Thus, a low cost multi-orifice liquid jet recording head having a high positioning precision and a high record quality is provided.

(5) In manufacturing the multi-orifice color head having a plurality of heads having liquids of different colors injected therein, the heads can be simply distinguished from each other by the projecting or recessed members or grooves formed in the heads. Thus, misarrangement of the heads or misinjection of color liquids is prevented.

Where the recording head unit which includes the ink container is used, no external ink supply tube is required and the construction is simplified. Since the recording head unit can be easily removed from the carriage, it can be readily exchanged when it fails or the ink has been exhausted. Where ink of one color is filled in the ink containers of a plurality of recording heads high speed printing is attained and the printing may be done for a longer time because of increased ink quantity. Where inks of different colors are filled in the ink containers of the recording head units, color recording is attained. The colors may be readily changed because the recording head unit can be easily exchanged. In the present invention, the recording head units may be of the same shape and can be mass-produced by molding.

In the liquid jet recording head in which a liquid path wall made of a photo-sensitive resin hardened film and a liquid reservoir wall are formed in a substrate on which a liquid discharge energy generator is mounted and a cover is formed on the photo-sensitive resin hardened film, dyes or pigments of different colors are added to the photo-sensitive resins in accordance with the colors of the liquids of the respective liquid jet recording heads or nozzle densities of the heads to manufacture the photo-sensitive resins of different colors so that the respective recording heads can be distinguished by color. As a result, the following advantages are offered.

(1) Where two or more heads of the same design are arranged to form a color liquid jet recording head, the photo-sensitive resins having colors corresponding to the colors of inks used are used. Thus, the misarrangement of the heads and the misinjection of liquid are prevented, and the workability is improved and the number of steps is reduced.

(2) Where two or more liquid jet recording heads having different specifications and similar appearances are to be simultaneously manufactured, the colors of the photo-sensitive resins may be changed in accordance with the head specifications. As a result, misselection, e.g., of the heads of wrong specification is prevented and the workability is improved and the number of steps is reduced.

(3) As a result, the workability is improved, the number of steps is reduced and the cost of the liquid jet recording head is reduced. Further, the control of the process is simplified by the color classification.

The advantage of coloring is also remarkable in the recording head having no photo-sensitive resin. By combining the coloring of the recording head and the shape of the coupling means, the advantages described above are further enhanced.

The coupling means may be formed at the same position in each recording head. Where the recording heads are to be arranged in a predetermined order, the positions of the coupling means may be staggered from each other so that misarrangement is prevented. If the recording heads are color-classified, the workability is further improved and the mounting and exchange of the recording head are assured.

The embodiments of the present invention are now explained with reference to the drawings.

First Embodiment

Figure 8:
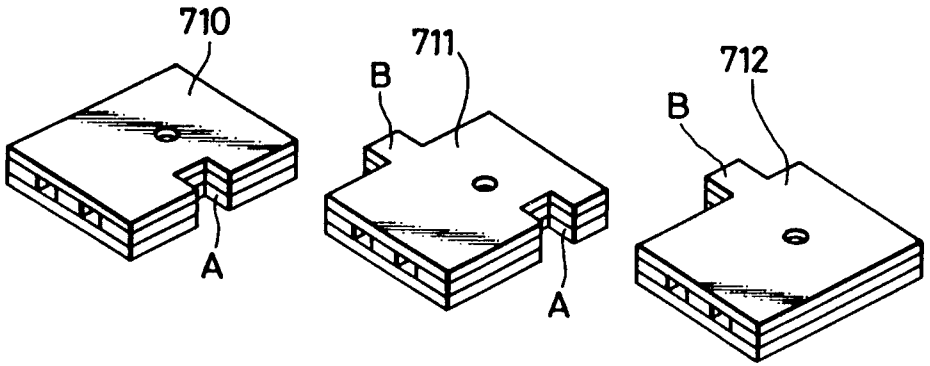
Figure 9:
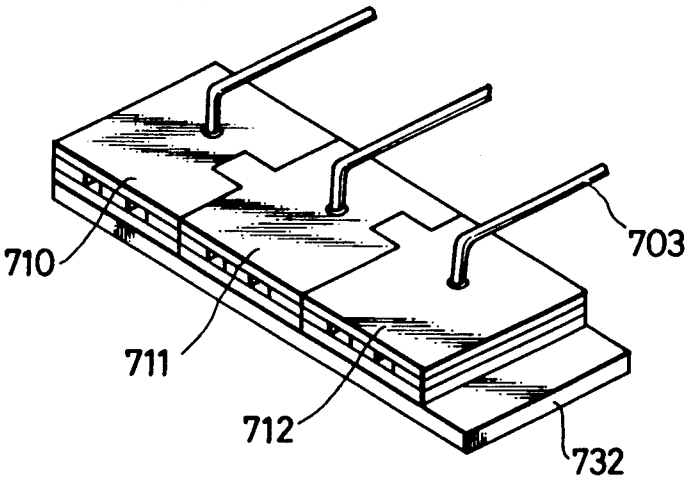
Figure 7:
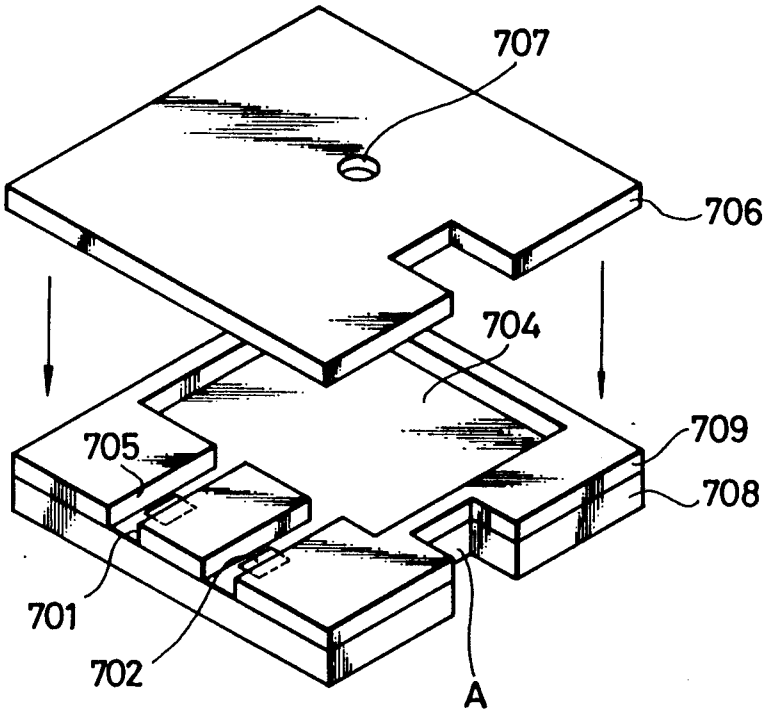

FIGS. 7 to 9 show a first embodiment of the present invention. Numeral 701 denotes an orifice, numeral 702 denotes a heat generating resistor for generating a discharge energy, numeral 703 denotes a liquid supply tube, numeral 704 denotes a liquid reservoir, numeral 705 denotes a liquid path, and numeral 708 denotes a ceramic substrate on which the heat generating resistor is mounted. A recess A is formed in a manufacturing step of the ceramic substrate. A wiring or electrical-lead means (not shown) for supplying an electrical signal to the heat generating resistor 702 is formed on the substrate. Numeral 709 denotes a photo-sensitive resin hardened film which forms the liquid path 705 communicating between the orifice 701, and the liquid reservoir 704. It is laminated on the substrate 708 and has the same contour as the substrate. Numeral 706 denotes a cover made of a photo-sensitive resin hardened film and it is laminated on the photo-sensitive resin hardened film 709. It is also patterned to have the same contour as the substrate. Numeral 707 denotes a liquid supply hole.

Numeral 710 shown in FIG. 8 denotes an individual, self-contained and self-supporting liquid jet recording head. Heads 711 and 712 are also manufactured in similar manners as the head 710 but have different contours. The head 711 has a projection B which is of complementary shape to the recess A, and the head 712 has a projection B which is to be fitted to the recess A of the head 711. Those heads 710, 711 and 712 are fitted to each other at the complementary fitting areas (coupling members) to form a multi-head as shown in FIG. 9. The fitted heads were bonded by adhesive material and a position error was measured. It was within $\pm 5$ μm for a design value. This precision is sufficient to make record by discharging droplets. In actual print operation, excellent print was attained.

Second Embodiment

Figure 12:
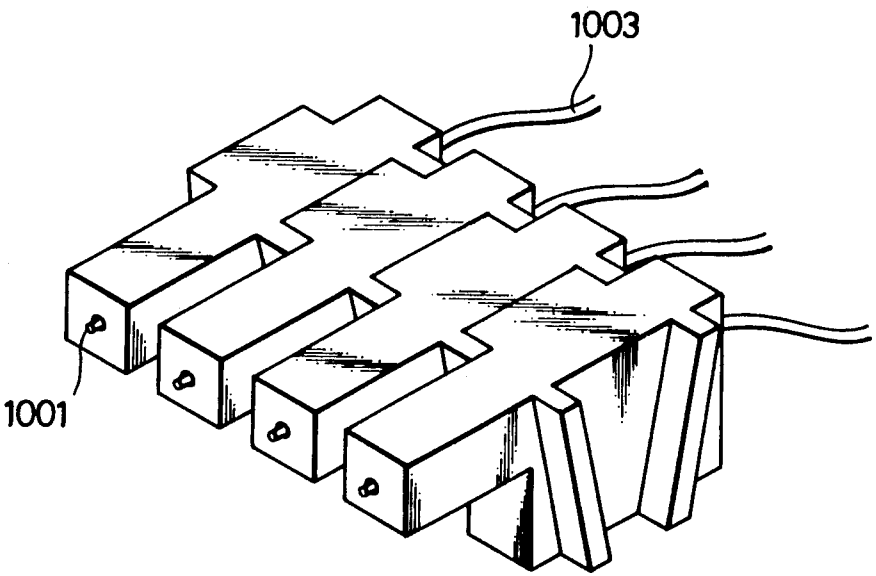
Figure 10:
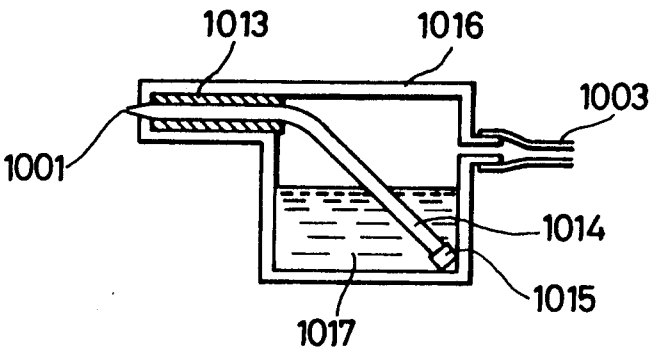
Figure 11:
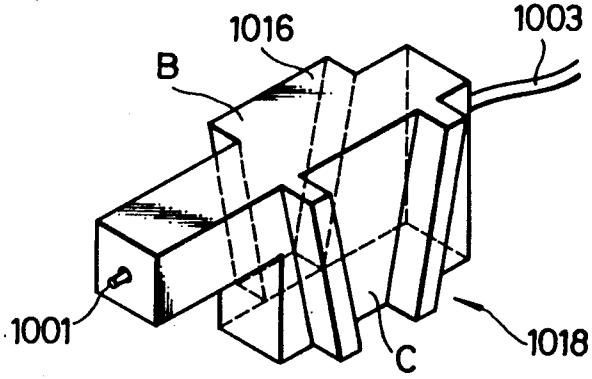

FIGS. 10–12 show a second embodiment of the present invention. FIG. 10 is a sectional view of an individual liquid jet recording head. Numeral 1001 denotes an orifice, numeral 1003 denotes a liquid supply tube, and numeral 1013 denotes a cylindrical piezo-electric element for generating a discharge energy. A fine glass tube 1014 is fitted to the cylindrical piezo-electric element 1013 and the orifice 1001 is formed at an end of the glass tube 1014, and a filter 1015 is attached to the other end. Numeral 1017 denotes recording liquid, and numeral 1016 denotes a head body which is molded by acryl resin.

FIG. 11 is a perspective view of the head. It has a projection B and a complementary recess C (pedestal in the present embodiment) are formed on the opposite sides of the body 1016. A plurality of liquid jet recording heads 1018 thus manufactured are fitted to each other at B and C to form a multi-orifice head as shown in FIG. 12.

A position error of the orifice in FIG. 12 was within $\pm 10$ μm for a design value.

In the present embodiment, the relative position of the liquid jet recording heads is significantly affected by the precision of molding of the body made of resin. Accordingly, the precision of a molding machine is required and the material should have minimal contraction, minimal thermal expansion and high molding ability. In the present embodiment, polycarbonate resin containing glass fiber by 40% and acryl resin containing glass fiber by 30% were used, although any resin which meets the above requirement may be used. In an actual liquid discharge test, good print was attained.

Third Embodiment

Figure 13:
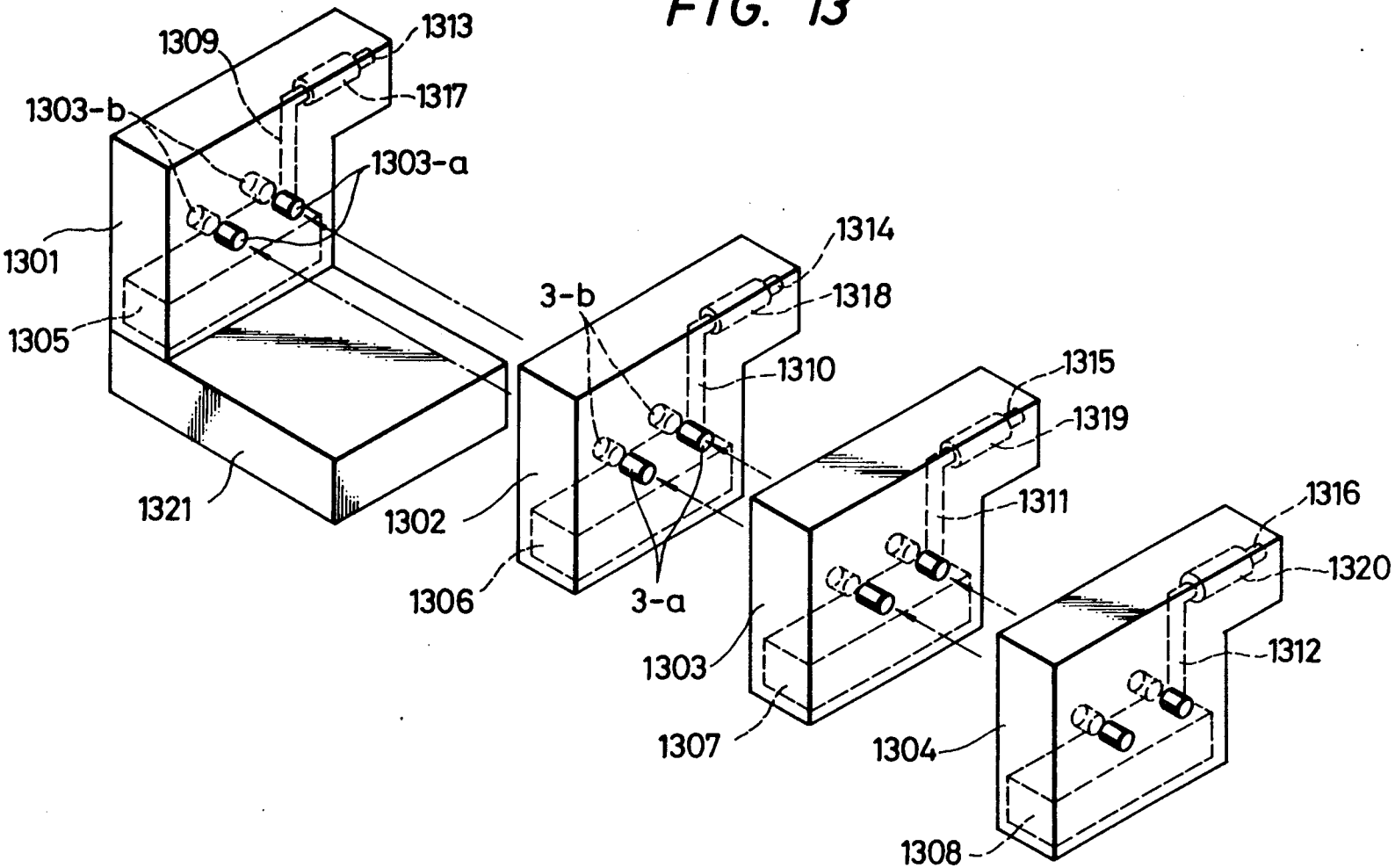

FIG. 13 shows a third embodiment of the ink jet printer of the present invention. Numerals 1301, 1302, 1303 and 1304 denote recording head units having ink containers 1305, 1306, 1307 and 1308, respectively. The ink containers are connected to nozzles 1313, 1314, 1315 and 1316 through ink supply tubes 1309, 1310, 1311 and 1312, respectively, and energy generators 1317, 1318, 319 and 1320 are arranged at the nozzles. By activating the energy generators, the inks in the ink containers are discharged from the nozzles. The head units are removably mounted on a carriage 1321, which is reciprocally moved along a guide shaft (not shown) fixed to a printer body.

The head units are of essentially identical shape and they are arranged side by side and fixed as shown in FIG. 13. Each head unit has projections **1303-*a* on one side and complementary recesses 1303-*b* on the other side to form coupling means. One head unit (for example, 1301) is fixed to the carriage 1321, and the recesses 1303-*b* of the head unit 1302 are fitted to the projections 1303-*a* of the head unit 1301 so that the head unit 1302 is coupled to the head unit 1301, and similarly the head unit 1303 is coupled to the head unit 1302 and the head unit 1304 is coupled to the head unit 1303**. In this manner, the relative arrangement of the nozzles of all head units is precisely defined based on one head unit. As a result, the reach points of the ink droplets discharged from the nozzles of the respective head units are relatively uniform, and since the distance between the head units is constant, high quality record is attained in high density recording and color recording.

While four head units are used in the embodiment of FIG. 13, the number of head units is not limited thereto. Where ink of one color is accommodated in the ink containers of the plurality of head units, a carriage scan distance may be small and high speed recording is attained. Where inks of different colors are accommodated in the ink containers, color recording is attained. For example, ink of one color may be accommodated in the ink containers of the head units 1301 and 1303, and ink of other color may be accommodated in the ink containers of the head units 1302 and 1304 to attain color printing. While one nozzle is arranged for each head unit in the present embodiment, a plurality of nozzles may be arranged in each unit.

The energy generators 1317, 1318, 1319 and 1320 of FIG. 13 may be electro-mechanical transducers (e.g. piezo-electric element) or electro-thermal transducers (e.g. heat generating resistors). The type of the energy generator is not important in the present invention and any energy generator which is applicable to the ink jet recording may be used.

Fourth Embodiment

Figure 14:
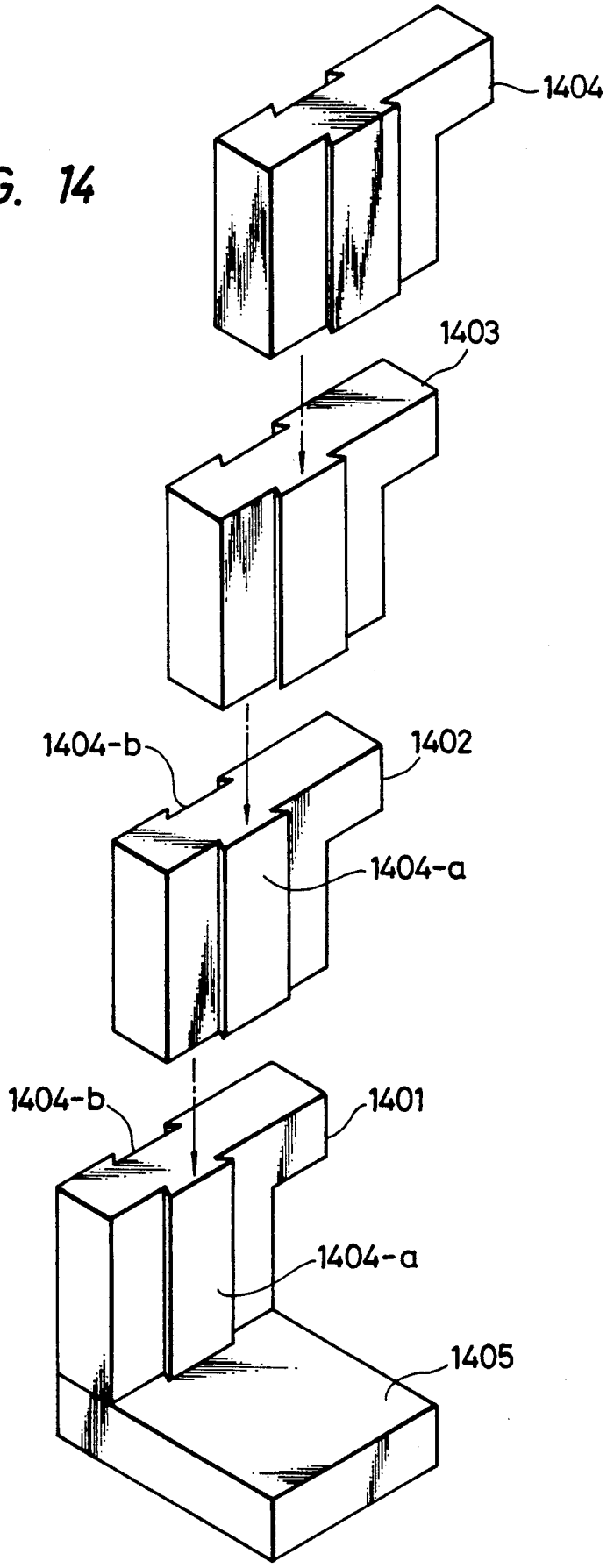
FIGS. 14, 15, 16 and 17 show ink jet printers of the present invention, respectively.

FIG. 14 shows a fourth embodiment of the present invention. Each head unit has a projection 1404-*a* on one side thereof and a recess 1404-*b* of a complementary shape to the projection 1404-*a* on the other side to form coupling means. A head unit 1401 is fixed to a carriage 1405, and head units 1402, 1403 and 1404 are coupled to the head units 1401, 1402 and 1403, respectively, by fitting the coupling means to each other so that the head units are removably mounted and positioned on the carriage. In the present embodiment, since the coupling means are larger and the contact areas of the coupling means are wider than those in the embodiment of FIG. 13, more precise positioning is attained and displacement due to an external force such as vibration is prevented. In the present embodiment, since the head units can be inserted and removed vertically, the compaction of the apparatus is further enhanced.

Fifth Embodiment

Figure 15:
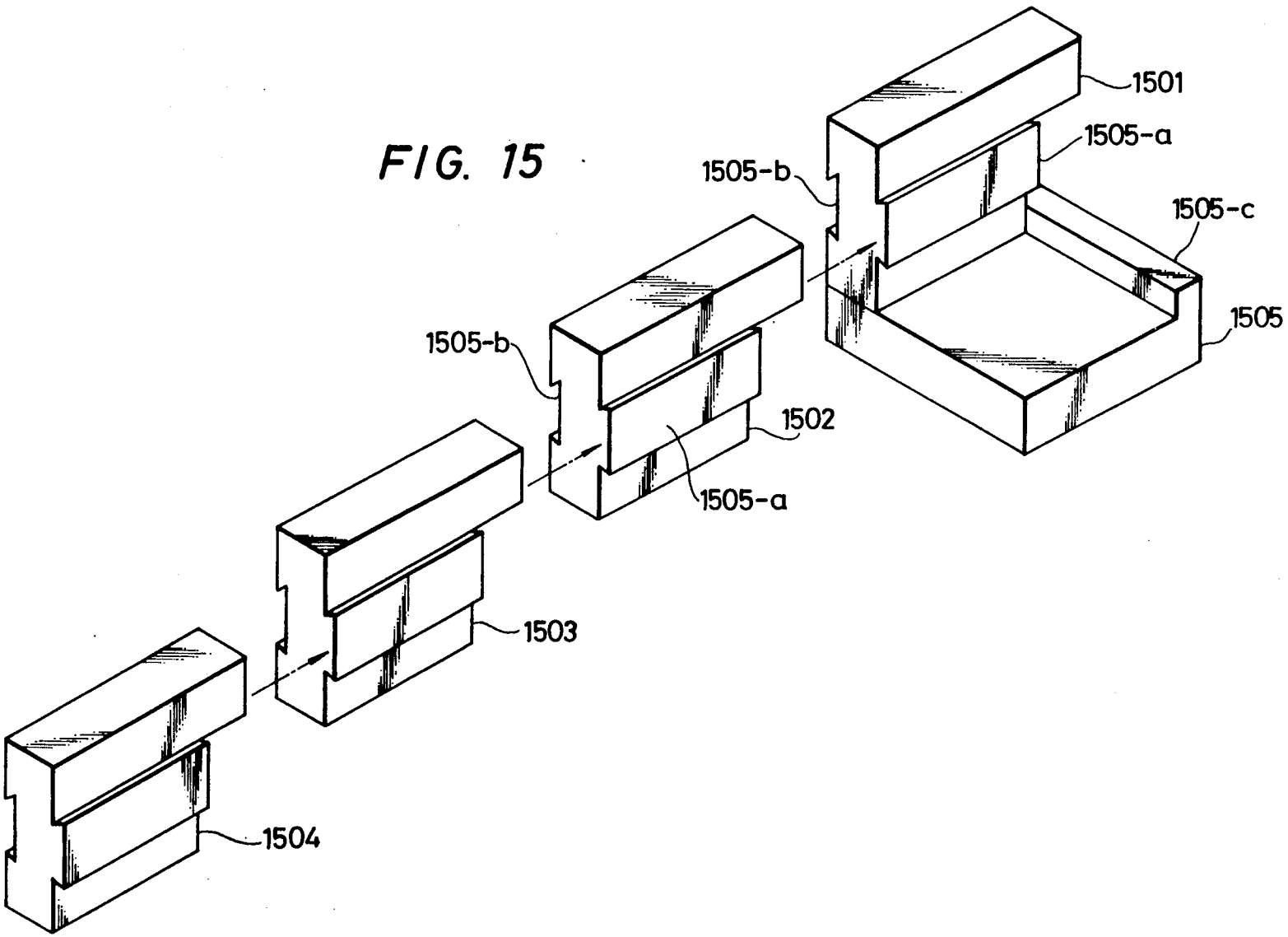

FIG. 15 shows a fifth embodiment. Each head unit has a projection 1505-*a* on one side thereof and a recess 1505-*b* of a complementary shape to the projection 1505-*a* on the other side to form coupling means. A head unit 1501 is fixed to a carriage 1505, and head units 1502, 1503 and 1504 are coupled to the head units 1501, 1502 and 1503, respectively, by the coupling means and are arranged on the carriage. In this manner, the head units are removably mounted and positioned on the carriage. In the present embodiment, since the coupling means are larger and the contact areas of the coupling means are wider than those of the embodiment of FIG. 13, more precise positioning is attained and the displacement due to the external force such as vibration is prevented. In the present embodiment, since the carriage 1505 has a head unit retainer 1505-*c*, a spacing between the head units and a record medium can be precisely maintained.

Sixth Embodiment

Figure 16:
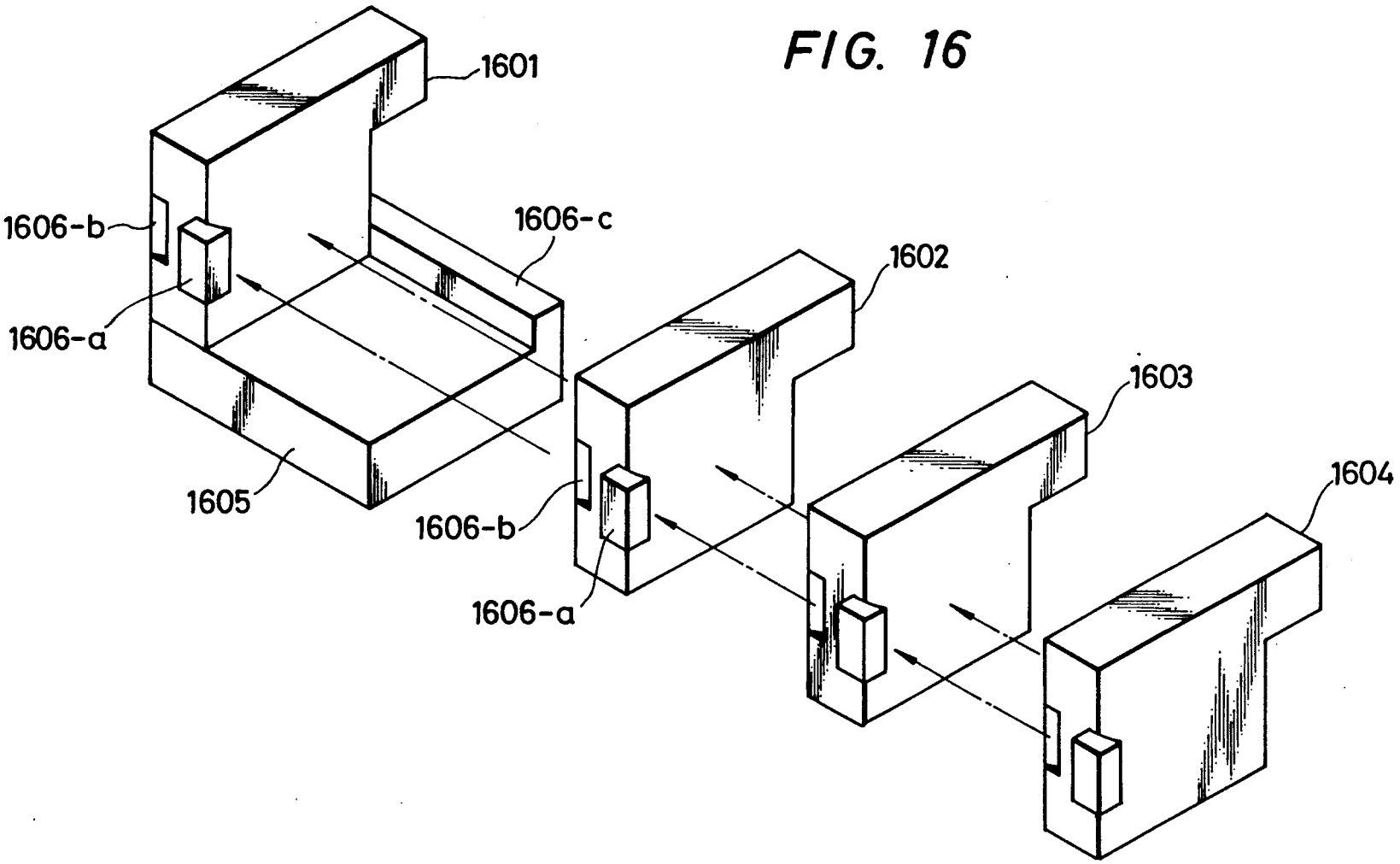

FIG. 16 shows a sixth embodiment of the present invention. Head units are positioned by a head retainer 1606-*c* formed on a carriage 1605 and coupling means 1606-*a* and 1606-*b* formed on each of the head units. In the present embodiment, the head unit 1601 is fixed to the carriage 1605. In the present embodiment, the head units are easily and precisely positioned as are done in the third embodiment.

Seventh Embodiment

Figure 17:
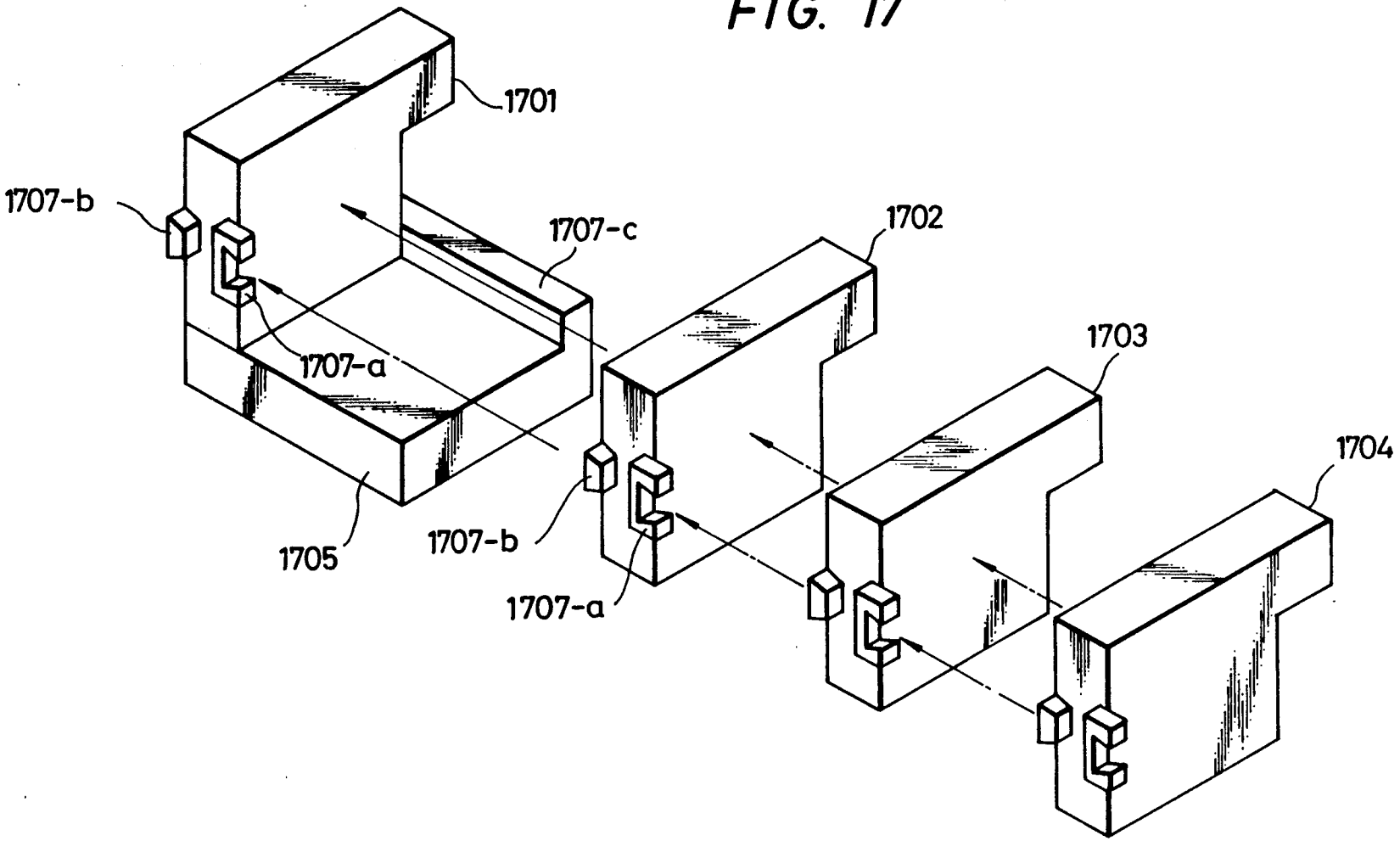

FIG. 17 shows a seventh embodiment of the present invention. Head units are positioned by a head retainer 1707-*c* formed on a carriage 1705 and coupling means 1707-*a* and 1707-*b* formed on the head units. In the present embodiment, the head unit 1701 is fixed to the carriage 1705. In the present embodiment, the head units are easily and precisely positioned as are done in the third embodiment.

Eighth Embodiment

Figure 18:
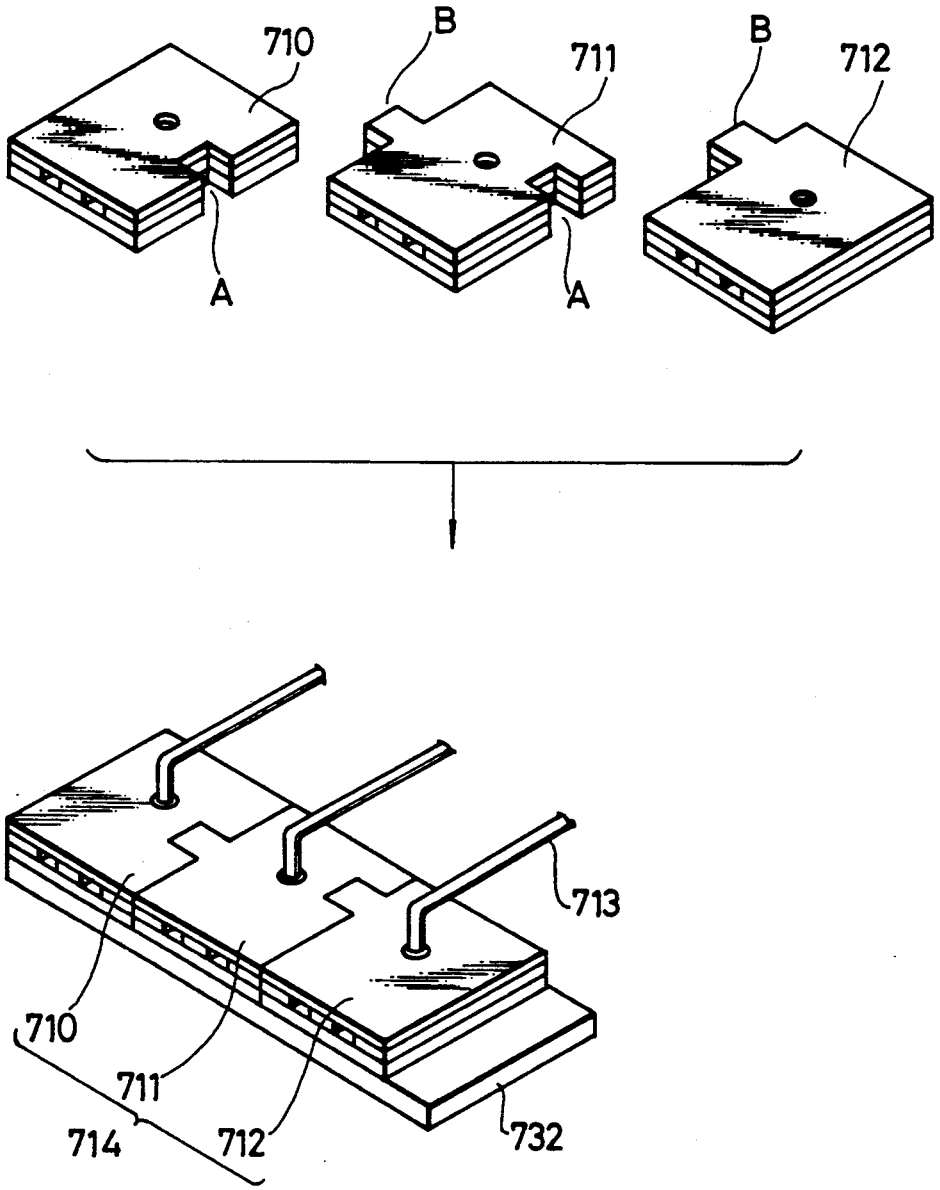

An eighth embodiment of the present invention is explained with reference to FIGS. 7 and 18. The like numerals to those shown in FIGS. 7–9 designate the like elements. A wiring for supplying an electrical signal to a heat generating resistor 702 is arranged on a substrate 708. Numeral 709 denotes a photosensitive resin hardened film which forms the liquid path and the liquid reservoir, and it is laminated on the substrate 708. Numeral 706 denotes a glass cover laminated on the photosensitive resin hardened film. Numerals 710–712 denote liquid jet recording heads thus manufactured, and numeral 714 denotes a color liquid jet recording head having the above heads arranged and fixed. Numeral 713 denotes a liquid supply tube for supplying liquid to the head and numeral 732 denotes a support plate on which the heads are fixed.

In the present embodiment, the photo-sensitive resin 709 is selected from the compositions shown in Table 1.

TABLE 1

| | (Embodiment 8) Color of Photosensitive resin | | |
|---|---|---|---|
| Composition | Red | Blue | Yellow |
| Photo-polymer monomer | % by weight) Pentaerythritol triacrylate 25 | % by weight) Pentaerythritol triacrylate 25 | % by weight) Pentaerythritol triacrylate 25 |
| Polymer | p-(methyl methacrylate/ methacrylic acid) 1/1 71.9 | p-(methyl methacrylate/ methacrylic acid) 1/1 71.9 | p-(methyl methacrylate/ methacrylic acid) 1/1 71.9 |
| Polymerization Initiator | Benzophenon 2.5 | Benzophenon 2.5 | Benzophenon 2.5 |
| Dye | Disperse Red (Nihon Kayaku) 0.3 | Disperse Blue 1 (Nihon kayaku) 0.3 | Disperse Yellow 1 (BASF) 0.3 |
| Thermal-polymerization inhibitor | 2-6-di-t-butyl-P-cresol 0.1 | 2-6-di-t-butyl-P-cresol 0.1 | 2-6-di-t-butyl-P-cresol 0.1 |
| Plasticizer | Polyethylene glycol 0.2 | Polyethylene glycol 0.2 | Polyethylene glycol 0.2 |
| Solvent | Methyl ethyl ketone | Methyl ethyl ketone | Methyl ethyl ketone |

The photo-sensitive resin has one of three colors, red, blue and yellow depending on the dye added.

In the color liquid jet recording head 714, the heads 710, 711 and 712 discharge liquids of yellow, magenta and cyan, respectively. Accordingly, in the present embodiment, the head 710 which discharges the yellow liquid is manufactured by the yellow photo-sensitive resin, the head 711 which discharges the magenta liquid is manufactured by the red photo-sensitive resin, and the head 712 which discharges the cyan liquid is manufactured by the blue photo-sensitive resin.

As a result, when the heads 710, 711 and 712 having similar shapes are to be assembled into the head 714, they are distinguished from each other by color and misarrangement of the heads is prevented and the workability is improved. After assembling into the head 714, liquids of respective colors are filled through the liquid supply tubes 713. In this case, since the heads are color classified, misinjection of the liquids is prevented. In the present embodiment, since each recording head has the coupling means A and B, the positioning of the recording heads is easily and precisely done.

Ninth Embodiment

Figure 19:
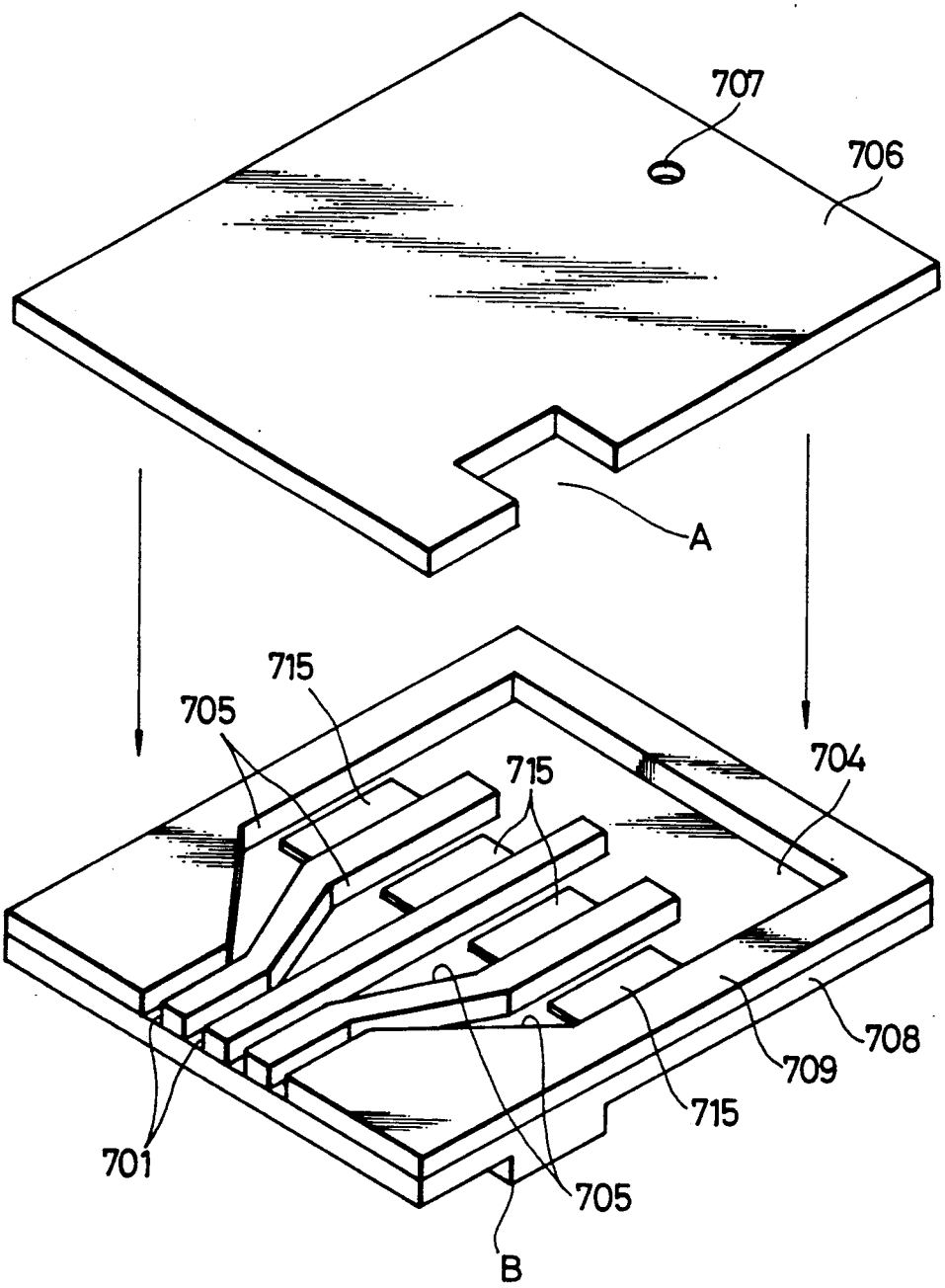
FIG. 19 is a developed perspective view and FIG. 20 illustrates the color liquid jet recording head formed by assembling the heads of FIG. 19.
Figure 20:
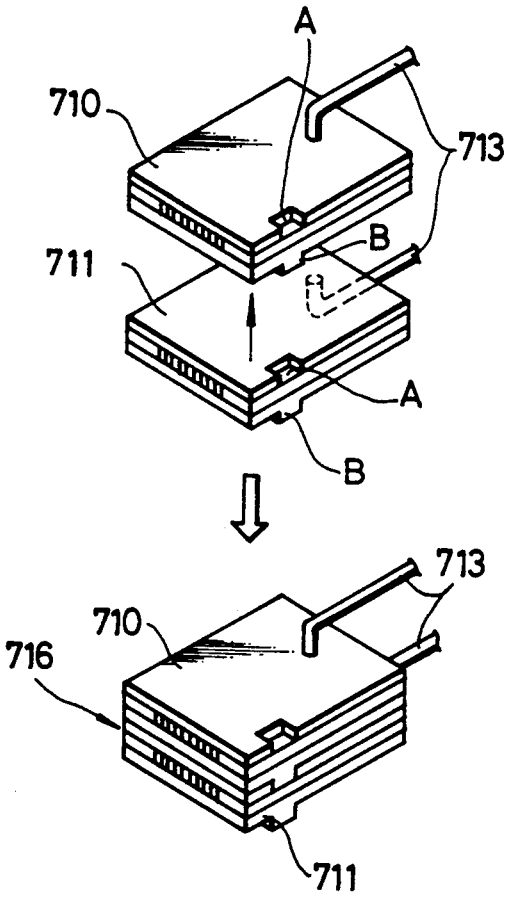

FIGS. 19 and 20 show a ninth embodiment of the present invention. The like elements to those shown in FIGS. 7 and 18 are designated by the like numerals. numeral 715 denotes a piezo-electric element for generating a discharge pressure. A wiring (not shown) for supplying an electrical signal to the piezoelectric element 715 is arranged on a substrate 708. Numerals 710 and 711 denote liquid jet recording heads thus manufactured, numeral 716 denotes a color liquid jet recording head formed by stacking the heads 710 and 711, and numeral 713 denotes a liquid supply tube for supplying the liquid to the head.

In the present embodiment, the photo-sensitive resin 709 is selected from the composition shown in Table 2.

TABLE 2

| | (Embodiment 9) Color of Photo-sensitive Resin | |
|---|---|---|
| Composition | White | Red |
| Photo-polymer monomer | (% by weight) Pentaerythritol triacrylate 25 | (% by weight) Pentaerythritol triacrylate 25 |
| Polymer | P-(methyl methacrylate/methacrylic acid) 1/1 72.1 | P-(methyl methacrylate/methacrylic acid) 1/1 72.1 |
| Polymerization initiator | Benzoin isobutyl ether 2.5 | Benzoin isobutyl ether 2.5 |
| Pigment | Titanium dioxide 0.1 | Molybdenum red 0.1 |
| Thermal-polymerization inhibitor | 2-6-di-t-butyl-p-cresol 0.1 | 2-6-di-t-butyl-p-cresol 0.1 |
| Plasticizer | Polyethylene glycol 0.2 | Polyethylene glycol 0.2 |
| Solvent | Methyl ethyl ketone | Methyl ethyl ketone |

The photosensitive resin has one of two colors, white and red depending on the pigment added. In the color liquid jet recording head 716, the head 710 discharges black liquid and the head 711 discharges red liquid. In the present embodiment, the head 710 which discharges the black liquid is manufactured by the white photo-sensitive resin, and the head 711 which discharges the red liquid is manufactured by the red photo-sensitive resin.

As a result, when the heads 710 and 711 of similar shape are to be assembled into the head 716, they can be easily distinguished by color, and misarrangement is prevented and the workability is improved. After assembling into the head 716, liquids of respective colors are injected through the liquid supply tubes 713. In this case, misinjection of the liquids is prevented because of the color classification of the heads. In the present embodiment, because of the coupling means A and B, the coupling and positioning of the recording heads are facilitated.

Tenth Embodiment

Figure 21:
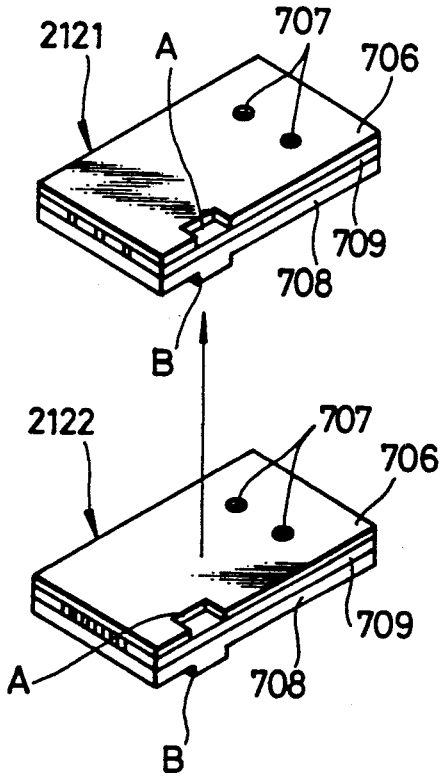
FIG. 21 shows a tenth embodiment of the present invention.

FIG. 21 shows a tenth embodiment of the present invention. Liquid jet recording heads 2121 and 2122 are manufactured in the same manner as described in the first embodiment of the present invention but the heads 2121 and 2122 have different orifice pitches. The head 2121 has an orifice pitch of 4/mm and the head 2122 has an orifice pitch of 8/mm. Except this difference, the heads 2121 and 2122 are very similar in appearance. When two or more types of heads which are very similar in appearance but have different specifications are to be simultaneously manufactured in a production line, those heads are difficult to be distinguished because the orifices are very small. Although an effort is made by process management to prevent mixing of the different types of heads, they are frequently mixed by accident. In the present embodiment, the head 2121 is manufactured by the red photo-sensitive resin and the head 2122 is manufactured by the blue photo-sensitive resin. The compositions of the photo-sensitive resin are shown in Table 3. In this manner, the heads are color classified and the mixing thereof is prevented even if they are manufactured in the same production line. In the present embodiment, because of the coupling means A and B, the heads are easily and precisely positioned and assembled. The coupling means A of the head 2121 and the coupling means B of the head 2122 may be omitted, so as to improve the ease and reliability of positioning and assembling of the heads.

TABLE 3

| | (Embodiment 10) Color of Photo-sensitive Resin | |
|---|---|---|
| Composition | Red | Blue |
| Photo-polymer monomer | (% by weight) Tetraethylene glycol-diacrylate 25 | (% by weight) Tetraethylene glycol-diacrylate 25 |
| Polymer | P-(acrylonitril/butadiene/stylene) 2/1/1 71.9 | P-(acrylonitril/butadiene/stylene) 2/1/1 71.9 |
| Polymerization initiator | Benzophenone 2.5 | Benzophenone 2.5 |
| Dye | Solvent Red 82 (Hodogaya Chemical) 0.3 | Solvent Blue 11 (Sumitomo Chemical) 0.3 |
| Thermal-polymerization inhibitor | 2-6-di-t-butyl-p-cresol 0.1 | 2-6-di-t-butyl-p-cresol 0.1 |
| Plasticizer | Polyethylene glycol 0.2 | Polyethylene glycol 0.2 |
| Solvent | Methyl ethyl ketone | Methyl ethyl ketone |

In the embodiments of the present invention, the dyes and pigments shown in Tables 1–3 are used to color the photo-sensitive resins although other red dyes such as red dispersion dye, oil color or basic dye, red pigments such as plumbo-plumbic oxide, mercuric sulfide or quinocrydone, blue dyes such as blue dispersion, oil and basic dyes and blue pigments such as pyridian, cobalt blue (tenal blue) or cotarosianine blue. For yellow color, yellow dispersion, oil or basic dye may be used, or chromium yellow, quitanium yellow, strontium chromate, eitharge (lead monoxide) or isoindolinone erroredish may be used.

What is claimed is:

1. An ink jet recording apparatus for performing color recording by discharging different kinds of ink, the apparatus comprising:

a plurality of adjacent recording heads, each having at least one discharge port for discharging a kind of ink and an ink containing member for containing ink to be supplied to said discharge port; and engaging means having engaging portions disposed on each said recording head at a different position thereof for each said recording head, wherein said engaging means locates all of said recording heads at particular positions relative to the other said recording heads, with said discharge ports of all of said recording heads positioned precisely with respect to each other.

2. An apparatus according to claim 1, wherein said engaging portions include a combination of a recess portion and a projection portion on said ink containing members, wherein a projection portion on one said ink containing member engages a recess portion on an adjacent said ink containing member.

3. An apparatus according to claim 2, wherein each said recording head includes energy generating means comprising an electro-thermal transducer.

4. An apparatus according to claim 2, wherein each said recording head includes energy generating means comprising an electro-mechanical transducer.

5. An apparatus according to claim 2, wherein each said recording head is colored by a color corresponding to the color of the kind of ink to be supplied thereto.

6. An apparatus according to claim 2, wherein each said recording head is colored by a color corresponding to an orifice pitch.

7. An apparatus of claim 1, wherein each said plurality of recording heads is removable form said apparatus.

8. An apparatus according to claim 1, wherein each said recording head includes energy generating means comprising an electrothermal transducer.

9. An apparatus according to claim 1, wherein each said recording head includes energy generating means comprising an electro-mechanical transducer.

10. A according to claim 1, wherein each said recording head is colored by a color corresponding to the color of the kind of ink to be supplied thereto.

11. An apparatus according to claim 1, wherein each said recording head is colored by a color corresponding to an orifice pitch.

12. An ink jet recording apparatus for performing color recording by discharging different kinds of ink, said apparatus comprising:

a plurality of adjacent recording heads, each having at least one discharge port for discharging a kind of ink;

an ink containing member for containing ink to be supplied to said discharge ports; and engaging means having engaging portions disposed on each said recording head at a different position thereof for each said recording head, wherein said engaging means locates all of said recording heads at particular positions relative to the other said recording heads.

13. An apparatus according to claim 12, wherein said engaging portions include a combination of a recess portion and a projection portion, wherein a projection portion on one said recording head engages a recess portion on an adjacent said recording head.

14. An apparatus according to claim 12, wherein said engaging means locates said recording heads with said discharge ports of all of said recording heads positioned precisely with respect to each other.

15. An apparatus according to claim 12, wherein said engaging means maintains a permanent relationship of said recording heads.

* * * * *

UNITED STATES PATENT AND TRADEMARK OFFICE

CERTIFICATE OF CORRECTION

PATENT NO. : 5,148,194

DATED : September 15, 1992

INVENTOR(S) : NAOHITO ASAI ET AL.

It is certified that error appears in the above-identified patent and that said Letters Patent is hereby corrected as shown below:

ON THE TITLE PAGE:

[57] ABSTRACT

Line 1, "head" should read --apparatus-- and "recording appa-" should read --plurality of recording heads, each--.
Line 2, "ratus" should be deleted.

COLUMN 1

Line 53, "head" should read --heads--.
Line 68, "head" should read --heads--.

COLUMN 2

Line 9, "for" should read --is used for--.

COLUMN 3

Line 46, "aforementioned-photo" should read --aforementioned photo--.

COLUMN 5

Line 56, "move" should read --more-- and "or," should read --or orifices,--.

COLUMN 8

Line 3, "are" should be deleted.

--

UNITED STATES PATENT AND TRADEMARK OFFICE

CERTIFICATE OF CORRECTION

PATENT NO. : 5,148,194

DATED : September 15, 1992

INVENTOR(S) : NAOHITO ASAI ET AL.

It is certified that error appears in the above-identified patent and that said Letters Patent is hereby corrected as shown below:

COLUMN 12

Table 3, "acrylonitril" should read --acrylonitrile-- and "stylene" should read --styrene--.
Line 66, "blue." should read --blue, can be used.--.

COLUMN 13

Line 39, "form" should read --from--.

COLUMN 14

Line 7, "A" should read --An apparatus--.

Signed and Sealed this

Second Day of November, 1993

Attest:

Bruce Lehman

BRUCE LEHMAN

Attesting Officer

Commissioner of Patents and Trademarks